US005566742A

United States Patent [19]

Nemoto

[11] Patent Number: 5,566,742

[45] Date of Patent: Oct. 22, 1996

[54] CASTING METHOD USING CORE MADE OF SYNTHETIC RESIN, CORE MADE OF SYNTHETIC RESIN, AND CAST PRODUCT

[76] Inventor: Masaru Nemoto, 1867-1, Showa-Cho, Isesaki-Shi, Gunma-Ken, Japan

[21] Appl. No.: 404,431

[22] Filed: Mar. 15, 1995

[30] Foreign Application Priority Data

| | | | |
|---|---|---|---|
| Apr. 13, 1994 | [JP] | Japan | 6-074995 |
| May 12, 1994 | [JP] | Japan | 6-098556 |
| Jun. 9, 1994 | [JP] | Japan | 6-127669 |
| Jul. 22, 1994 | [JP] | Japan | 6-171181 |
| Dec. 5, 1994 | [JP] | Japan | 6-300951 |
| Dec. 5, 1994 | [JP] | Japan | 6-301126 |

[51] Int. Cl.[6] ..... B22C 9/10

[52] U.S. Cl. ..... 164/132; 164/369

[58] Field of Search ..... 164/369, 520, 164/529, 132, 131, 138, 411

[56] References Cited

U.S. PATENT DOCUMENTS

| | | | |
|---|---|---|---|
| 1,710,534 | 4/1929 | Field | 164/132 |
| 2,086,653 | 7/1937 | Watson et al. | 164/132 |
| 3,220,070 | 11/1965 | Tajkowski | 164/72 |
| 3,465,808 | 9/1969 | Uram | 164/132 |
| 4,106,548 | 8/1978 | Murza-Mucha et al. | 164/132 |
| 4,352,387 | 10/1982 | Yamaguchi | 164/132 |

FOREIGN PATENT DOCUMENTS

| | | |
|---|---|---|
| 144958 | 11/1981 | Germany . |
| 61-293646 | 12/1986 | Japan . |
| 6-87064 | 3/1994 | Japan . |
| 6-87063 | 3/1994 | Japan . |
| 6-87052 | 3/1994 | Japan . |
| 6-99436 | 4/1994 | Japan . |
| 6-99247 | 4/1994 | Japan . |
| 6-91345 | 4/1994 | Japan . |
| 6-91346 | 4/1994 | Japan . |
| 6-91656 | 4/1994 | Japan . |
| 6-126376 | 5/1994 | Japan . |
| 6-122037 | 5/1994 | Japan . |
| 6-198388 | 7/1994 | Japan . |
| 1764798 | 12/1990 | U.S.S.R. . |
| 2269771 | 2/1994 | United Kingdom . |

*Primary Examiner*— Joseph J. Hail, III
*Assistant Examiner*—Randolph Herrick
*Attorney, Agent, or Firm*—Jacobson, Price, Holman & Stern, PLLC

[57] ABSTRACT

A core 10 made of a synthetic resin is set in dies, and the dies are filled with a molten metal. The molten metal is cooled by the dies, whereby a cast product 12 including the synthetic resin core 10 is obtained. Totally heating the cast product 12, a projecting portion 10*a* of the synthetic resin core 10 is caught and pulled, whereby the synthetic resin core 10 is drawn in a semi-molten state out of the cast product 12.

8 Claims, 11 Drawing Sheets

CASTING METHOD USING CORE MADE OF SYNTHETIC RESIN, CORE MADE OF SYNTHETIC RESIN, AND CAST PRODUCT

BACKGROUND OF THE INVENTION

The present invention relates to a casting method using a core made of a synthetic resin, the core made of a synthetic resin, and a cast product, and more particularly to a casting method by which a cast product of a complicated shape can be formed easily and precisely, the core being made of a synthetic resin, and the cast product.

BACKGROUND ART

In casting for forming a cast product, a non-collapsible core or a collapsible core is used to form an inner space and an undercut portion. In this case, a metal core is used as a non-collapsible core, but it cannot be used in applications other than those which allow direct draw or deformation draw. Therefore, its application range is limited to specific shapes.

On the other hand, a sand core has generally been used as a collapsible core. The sand core, however, had various problems in that molding was difficult, that handling was difficult because it was easily collapsed, and it was difficult to provide both pressure resistance in casting and collapsibility after casting.

According to a more recent development, a special coating is applied to the surface of the sand core, but it has a big problem in that the coating ingredient permeates a cast product to cause negative effects such as porosities in the cast product which is, in turn, likely to be defective.

As described above, the application range of metal cores is limited to specific shapes, while the sand core is apt to be collapsed and handling thereof is thus difficult. Further, where the sand core is coated with a coating, there are problems that the coating ingredient permeates the cast product to produce porosities in the cast product and that it is difficult to remove the coating and sand core ingredients from the casting product after cast.

SUMMARY OF THE INVENTION

The present invention has been accomplished taking the above points into account, and an object of the invention is to provide a casting method using a core made of a synthetic resin, by which a cast product of a complicated shape can be accurately formed and by which the core can be drawn in a smooth manner from the casting product after cast, the core made of a synthetic resin, and the cast product.

A first feature of the present invention is a casting method using a synthetic resin core, which comprises:

a step of placing the synthetic resin core in dies;

a step of filling the dies in which the synthetic resin core is placed, with a molten metal;

a step of cooling the molten metal using the dies to form a cast product; and a step of taking the cast product and the synthetic resin core out of the dies, thereafter heating the cast product and the synthetic resin core to draw the synthetic resin core in a semi-molten state out of the cast product, and thereby forming an inner space in the cast product.

A second feature of the present invention is a casting method using a synthetic resin core, which comprises:

a step of placing the synthetic resin core in dies;

a step of filling the dies in which the synthetic resin core is placed, with a molten metal;

a step of cooling the molten metal using the dies to form a cast product; and a step of taking the cast product and the synthetic resin core out of the dies, and thereafter heating the cast product and the synthetic resin core in a furnace to melt the synthetic resin core to then remove the synthetic resin core out of the cast product.

A third feature of the present invention is a casting method using a synthetic resin core, which comprises:

a step of placing the synthetic resin core in dies;

a step of filling the dies in which the synthetic resin core is placed, with a molten metal;

a step of cooling the molten metal using the dies to form a cast product; and a step of taking the cast product and synthetic resin core out of the dies and thereafter immersing the cast product and the synthetic resin core in a solvent to dissolve the synthetic resin core out of the cast product.

A fourth feature of the present invention is a core made of a synthetic resin.

A fifth feature of the present invention is a core made of a synthetic resin, which comprises a core body made of a heat-resistant synthetic resin and having a space inside thereof.

A sixth feature of the present invention is a core for forming a die cast product, to be set in a cavity in die casting dies, wherein the core for die casting comprises:

a synthetic resin portion extending in the cavity of the dies; and a metal portion connected to the synthetic resin portion, provided at an end portion in the cavity of the dies and at a position corresponding to a thick end portion of the cast product, and projecting outwardly from the cavity.

A seventh feature of the present invention is a core for forming a die cast product, to be set in a cavity in die casting dies, wherein the core for die casting has a synthetic resin portion arranged to extend in the cavity of the dies, wherein a metal portion is embedded at a position in the synthetic resin portion, corresponding to an inside thick portion of the cast product.

An eighth feature of the present invention is a cast product having an inner space, which is cast by the method of the present invention.

According to the first feature, the cast product can be accurately formed using the synthetic resin core and after casting, the core can be removed out of the cast product without having scraps of core in the cast product, simply by heating the cast product and drawing out the synthetic resin core in the semi-molten state.

According to the second feature, the synthetic resin core is melted in the furnace to be removed out of the cast product.

According to the third feature, the synthetic resin core can be dissolved out of the cast product in a solvent.

According to the fourth feature, the core can be removed out of the cast product without leaving scraps of core in the cast product, simply by heating the cast product after casting and drawing out the synthetic core in the semi-molten state.

According to the fifth feature, the cast product can be accurately formed by using the synthetic resin core consisting of the core body made of the heat-resistant synthetic resin and having a space inside, and the core can be removed out of the cast product without leaving scraps of core in the cast product, simply by heating the cast product after casting and drawing out the synthetic resin core in the semi-molten state. Since the core body made of the synthetic resin has a space inside, the material costs can be reduced.

According to the sixth feature, the core is set in the cavity and is filled with the molten metal. Since the metal portion is provided at the cavity end portion and at the position corresponding to the end thick portion of the cast product, there is no imbalance between an amount of heat conduction from the molten metal to the dies and an amount of heat conduction from the molten metal to the metal portion of the core at the position corresponding to the thick end portion, thereby preventing shrinkage at the thick end thick portion of the cast product.

According to the seventh feature, the core is set in the cavity and is filled with the molten metal. Since the metal portion is embedded at the position corresponding to the inside thick portion of the synthetic resin portion, there is no imbalance between an amount of heat conduction from the molten metal to the dies and an amount of heat conduction from the molten metal to the embedded metal portion of the core at the position corresponding to the inside thick portion, thereby preventing shrinkage at the inside thick portion of the cast product.

According to the eighth feature, casting can be done without leaving scraps of core in the inner space.

DETAILED DESCRIPTION OF THE INVENTION

FIRST EMBODIMENT

The first embodiment of the present invention will be described with reference to the drawings.

Figure 2:
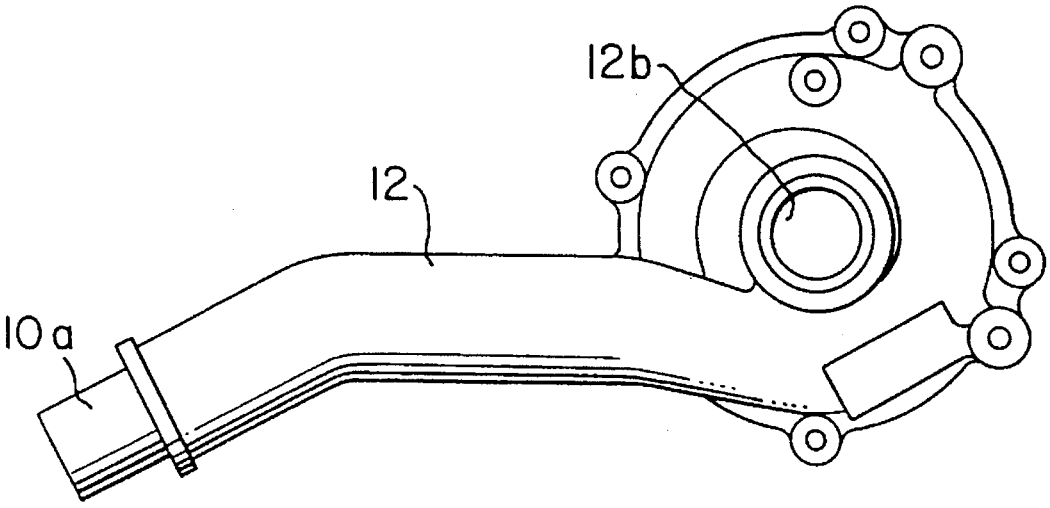
FIG. 2 is a plan view to show the core made of the synthetic resin and the cast product shown in FIG. 1.
Figure 3:
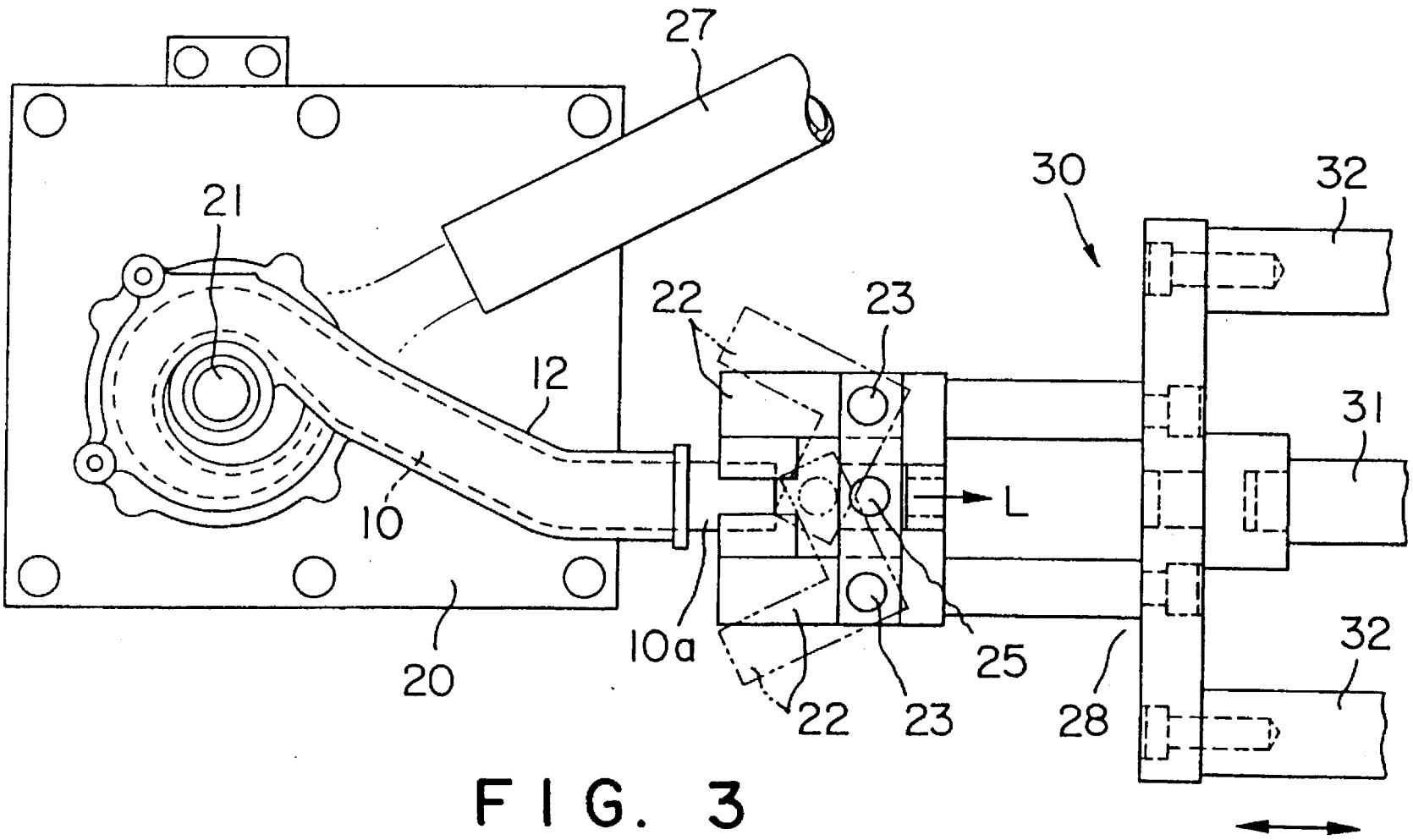
FIG. 3 is a plan view to show a core drawing apparatus for the core made of the synthetic resin.
Figure 4:
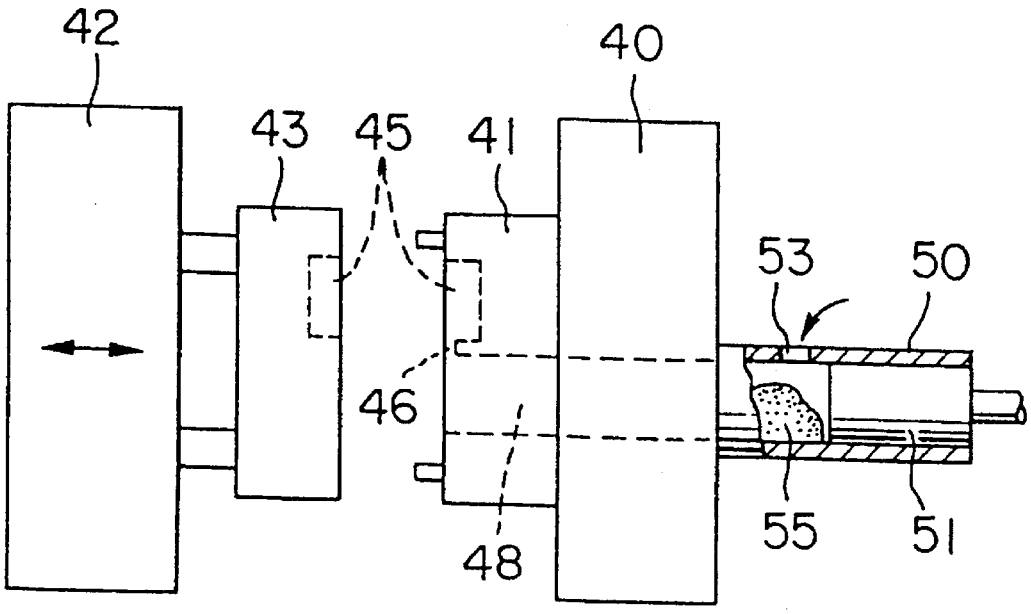
FIG. 4 is a schematic drawing to show an aluminum die casting apparatus.

FIG. 1 to FIG. 5 are drawings to show an embodiment of the present invention. First, the schematic of an aluminum die casting apparatus is described referring to FIG. 4. As shown in FIG. 4, the aluminum die casting apparatus is provided with a steel, stationary die 41 fixed to a stationary platen 40 and a steel, movable die 43 fixed to a movable platen 42, and is so arranged that when the stationary die 41 and movable die 43 are brought into close fit, a cavity 45 is formed between the two dies.

A cylinder 50 is provided on the opposite side to the stationary die 41 in the stationary platen 40, and a piston 51 is slidably arranged in the cylinder 50. The cylinder 50 is provided with an input port 53 through which molten aluminum is put into the cylinder.

The inside of cylinder 50 communicates through a sprue 48 with the cavity 45 formed between the stationary die 41 and the movable die 43, and a gate 46 is provided at an exit of sprue 48 on the cavity 45 side.

Figure 1:
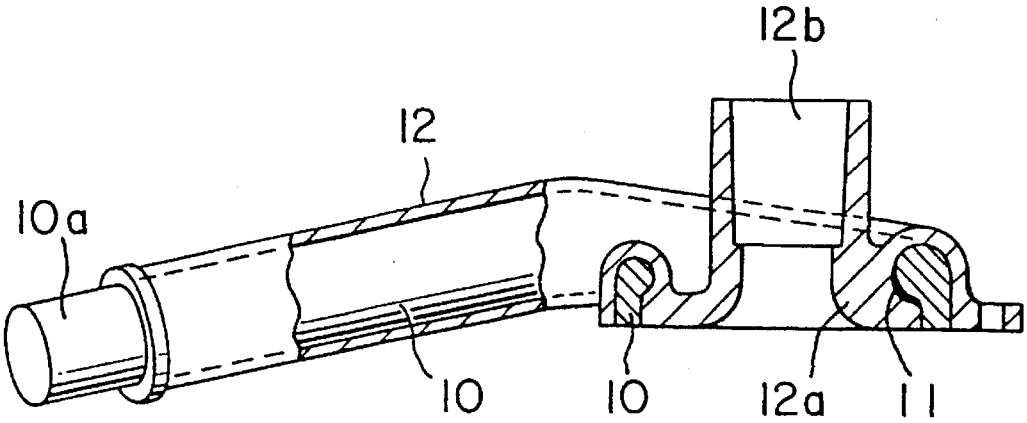
FIG. 1 is a partial, sectional view to show a core made of a synthetic resin and a cast product to represent a first embodiment of the present invention.

A synthetic resin core 10 is set in the cavity 45 formed between the stationary die 41 and the movable die 43, and an aluminum cast product 12 is formed with this synthetic resin core 10 (FIG. 1 and FIG. 2).

The synthetic resin core 10 is next described referring to FIG. 1 and FIG. 2. In FIG. 1 and FIG. 2, the synthetic resin core 10 is made of a synthetic resin, for example of heat-resistant polycarbonate, and the synthetic resin core 10 has a projecting portion 10*a* which slightly projects from the cast product 12 after casting.

A portion of the synthetic resin core 10 corresponding to (or in contact with) a thick portion 12*a* of the cast product 12 is coated with silicone rubber 11 having a strong heat resistance. The thick portion 12*a* of cast product 12 is a portion where an escape of heat is slow. Because of it, the polycarbonate core 10 could be melted near the thick portion 12*a*. Therefore, the coating of the silicone rubber 11 is provided to prevent melting of polycarbonate core 10.

A core drawing apparatus is next described referring to FIG. 3. As shown in FIG. 3, the core drawing apparatus has a locking device 20 for locking the cast product 12 after casting, and a burner 27 for heating the cast product 12 locked by the locking device 20. An engagement pin 21 to be engaged with a hollow portion 12*b* of the cast product 12 (FIG. 1 and FIG. 2) is fixed in the locking device 20.

Also, as shown in FIG. 3, a clamp device 30 for clamping and pulling the projecting portion 10*a* of core 10 projecting from the cast product 12 is provided beside the locking device 20. This clamp device 30 has a pair of holding pawls 22, 22 arranged so as rockable through on rocking shafts 23, 23 on a frame 28, and this pair of holding pawls 22, 22 hold the projecting portion 10*a* of the core. Namely, the pair of holding pawls 22, 22 are connected to each other through a connecting shaft 25, and are actuated to be closed when a pneumatic cylinder not shown pulls the connecting shaft 25 in the direction of arrow L in FIG. 3.

The frame 28 is arranged to be moved in the horizontal directions in FIG. 3 via a drive shaft 31 driven by a hydraulic cylinder not shown, and the horizontal movement of the frame 28 is guided by a pair of guides 32, 32.

The operation of the present embodiment in the above arrangement is next described. First, in FIG. 4, the synthetic resin core 10 is set at a predetermined position in the stationary die 41, and thereafter the movable platen 42 and movable die 43 are moved toward the stationary platen 40 and stationary die 41 to make the movable die 43 closely fit with the stationary die 41. In this case, the cavity 45 is formed between the stationary die 41 and the movable die 43 whereby the core 10 is set in the cavity 45.

Figure 5:
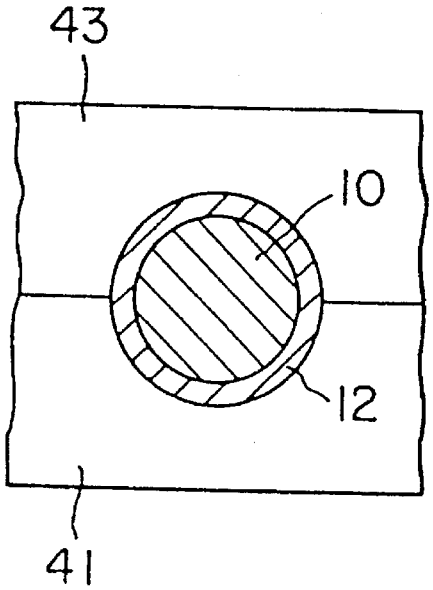
FIG. 5 is a sectional view to show the placement of the synthetic resin core and the cast product in a stationary die and a movable die.

Next, molten aluminum 55 at about 680° C. is put into the cylinder 50 through the input port 53 thereof and then the molten aluminum 55 is pushed toward the sprue 48 by the piston 51. The molten aluminum 55 entering the sprue 48 is injected through the gate 46 into the cavity 45 to fill a space formed by the stationary die 41, movable die 43, and core 10 (FIG. 5). The molten aluminum 55 flowing from the gate 46 into the cavity 45 is sprayed, and the temperature thereof becomes about 600° C.

Next, the molten aluminum 55 which fills the cavity 45 is rapidly cooled by the stationary die 41 and movable die 43 to form the aluminum cast product 12.

During this period, heat transfer occurs also from the molten aluminum 55 to the synthetic resin core 10 of polycarbonate. However, because the thermal conductivity of the synthetic resin core 10 is normally far smaller than that of the steel stationary die 41 and movable die 43 (for example, the thermal conductivity of polycarbonate is $4.6\times 10^{-4}$ cal/s•cm° C. while the thermal conductivity of iron is 0.18 cal/s•cm° C.), an amount of heat transfer from the molten aluminum 55 to the synthetic resin core 10 becomes extremely small. Thus, the synthetic resin core 10 is not melted during casting, and the cast product 12 can be formed with excellent accuracy of shape.

The synthetic resin core 10 will not be melted even with slow escape of heat from the thick portion 12*a*, because the surface of the synthetic resin core 10 near the thick portion 12*a* of cast product 12 is coated with very-high-temperature-resistant silicone rubber 11.

Next, the movable die 43 is separated from the stationary die 41, and the aluminum cast product 12 and synthetic resin core 10 are taken together out of the cavity 45 formed between the stationary die 41 and the movable die 43 (FIG. 1 and FIG. 2).

Next, the cast product 12 and synthetic resin core 10 are set on the locking device 20 shown in FIG. 3. In this case, the hollow portion 12*a* of cast product 12 is engaged with the engagement pin 21 of locking device 20 to be fixed there.

Then the cast product 12 is totally heated by the burner 27 to heat the synthetic resin core 10 of polycarbonate up to about 280° to 350° C. Since the softening point of polycarbonate is 160° C. and the melting point thereof is 380° to 400° C., the whole of core 10 turns into a semi-molten state when the synthetic resin core 10 is heated up to about 280° to 350° C. Out of the synthetic resin core 10, the projecting portion 10*a* is not heated as much so as to be kept in a hard state.

Then the frame 28 of the clamp device 30 is moved all the way to the cast product 12 and thereafter the pair of holding pawls 22 hold the projecting portion 10*a* of the synthetic resin core 10. In this state the entire frame 28 is moved away from the cast product 12 by the drive shaft 31. In this case, the synthetic resin core 10 inside the cast product 12, being semi-molten, is integrally drawn rightward in FIG. 3 from the cast product 12.

Figure 22:
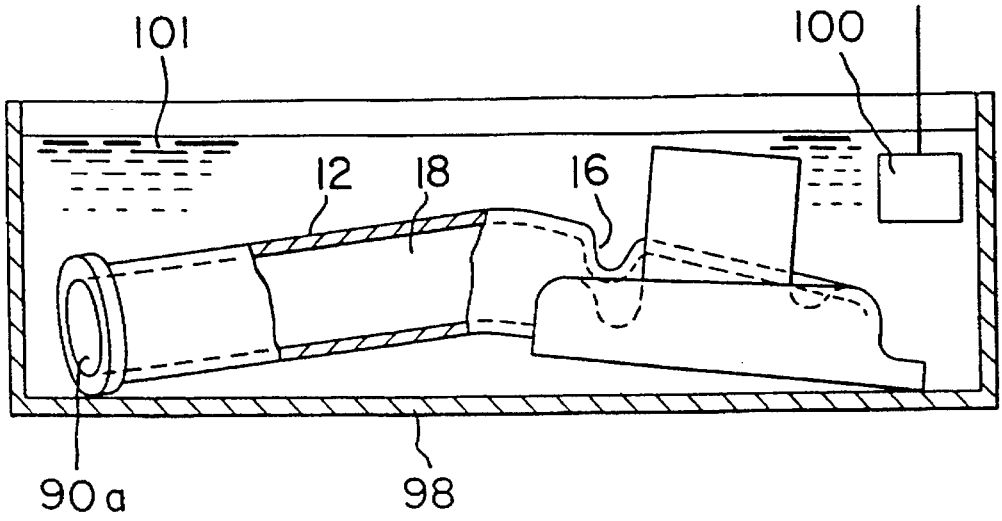
FIG. 22 is a drawing to show a method for removing a residual part of core remaining in an internal space in a cast product by a solvent.

After that, the cast product 12 is taken out of the locking device 20. Since the synthetic resin core 10 is integrally drawn in the semi-molten state from the cast product 12, no scraps of core will remain in the inner space 18 of cast product 12 (FIG. 22). Accordingly, the cast product 12 can be shipped as a final product as is. On the other hand, the synthetic resin core 10 drawn from the cast product 12 is collected for reuse to form another core.

As described above, according to the present embodiment, the aluminum cast product 12 can be formed easily and accurately formed by using the synthetic resin core 10 of polycarbonate. The core 10 can be removed from the cast product 12 without any residual scraps of core in the cast product 12 simply by heating the casting product 12 after casting and by drawing out the synthetic resin core 10 in the semi-molten state.

Modifications of the present invention will be described in the following.

The above embodiment showed an example in which the silicone rubber was applied to the surface of polycarbonate core 10 located near the thick portion 12*a* of cast product 12, but the silicone rubber may be replaced by a thermosetting resin selected for example from melamine resins, phenol resins, urea resins, epoxy resins, silicon resins, polyurethane resins, and the like.

Figure 6:
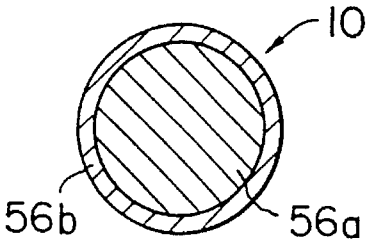
FIG. 6 is a drawing to show a modification of the core.

Also, the above embodiment showed an example in which the synthetic resin core 10 was the polycarbonate core, but, without a need to be limited to it, the synthetic resin core 10 may be one consisting of a thermoplastic inner resin 56*a* and a heat-resistant resin 56*b* covering the entire surface of the inner resin 56*a*, as shown in FIG. 6.

In this case, the thermoplastic inner resin 56*a* may be selected from fluororesins (polyfluoroethylene resins) such as ethylene tetrafluoride, polyimide resins, polyamideimide resins, polysulfone resins, vinyl chloride resins, polyamide resins (nylon resins), polypropylene resins, polyethylene resins, polyester resins (Tetron resins), or polysulfonic acid resins.

The heat resistant resin 56*b* covering the entire surface of the inner resin 56*a* may be the silicone rubber as described previously, or a silicon resin.

Figure 7:
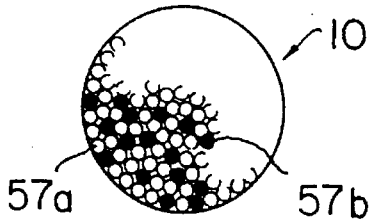
FIG. 7 is a drawing to show a modification of the core.

Further, the synthetic resin core 10 may be made of a material obtained by mixing particles 57*a* of a thermoplastic resin such as a polypropylene resin with particles 57*b* of a heat-resistant resin such as a silicon resin, as shown in FIG. 7, and heating the mixture under pressure to harden the mixture. Also, the synthetic resin core 10 may be made of a material obtained by mixing the polypropylene resin particles with either calcium carbonate particles, calcium sulfate particles, or calcium silicate particles, heating the mixture under pressure to harden the mixture.

Further, a biodegradable plastic may be used for the synthetic resin core 10. Here, the biodegradable plastic means a plastic which is decomposed into low-molecular-weight compounds giving no negative effects to the environment, in connection with microorganisms in nature.

The biodegradable plastic can be classified into the complete degradation type and partial degradation type. The complete degradation type plastic may include plastics of naturally-occurring polymers consisting of a complex of starch and modified polyvinyl alcohol, starch and polycaprolactone, or chitosan and cellulose; fermentation product plastics consisting of a microorganism-produced polyester or a microorganism-derived cellulose; and synthetic plastics consisting of an aliphatic polyester. The partial degradation type plastic may include plastics of a mixture of starch in polyethylene, and alloys of polycaprolactone and a general-purpose plastic.

When the biodegradable plastic core is used, the core can be readily discarded after casting.

Figure 8:
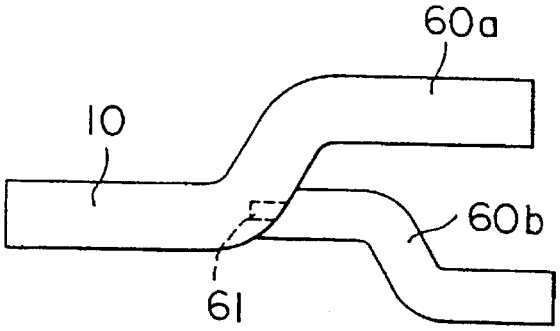
FIG. 8 is a drawing to show a modification of the core.

In another modification, as shown in FIG. 8, the synthetic resin core 10 may be composed of a first member 60*a* and a second member 60*b* removably attached to the first member 60. In this case, the synthetic resin core 10 is assembled by inserting a projection 61 of the second member 60*b* into an insert hole formed in the first member 60*a*. As in this modification, a cast product 12 with a complicated shape can be readily formed by assembling the core 10 with the first member 60*a* and second member 60*b*.

In the above embodiment the aluminum die casting method was described as a die casting method, but the casting method of the present invention can be applied to any other die casting methods, such as the gravity die casting method, the low pressure die casting method, and the precision die casting method. Further, the cast product may be not only of aluminum, but also of lead, zinc, magnesium, manganese or an alloy thereof.

As described above, according to the present invention, the cast product can be formed with high accuracy using the synthetic resin core and the core can be readily removed from the cast product without leaving scraps of core in the cast product after casting. Therefore, a cast product having excellent accuracy of shape can be quickly formed.

SECOND EMBODIMENT

The second embodiment of the present invention will now be described with reference to the drawings.

FIG. 9 to FIGS. 11A and 11B are drawings to show the second embodiment of the present invention. The same portions as those in the first embodiment are described with the same reference numerals. As shown in FIG. 4, the aluminum die casting apparatus is provided with the steel, stationary die 41 fixed to the stationary platen 40 and the steel, movable die 43 fixed to the movable platen 42, and is so arranged that when the stationary die 41 and movable die 43 are brought into close fit, the cavity 45 is formed between the two dies, similarly as in the first embodiment.

The cylinder 50 is provided on the opposite side to the stationary die 41 in the stationary platen 40, and the piston 51 is slidably arranged in the cylinder 50. The cylinder 50 is provided with the input port 53 through which molten aluminum is put into the cylinder.

The inside of cylinder 50 communicates through the sprue 48 with the cavity 45 formed between the stationary die 41 and the movable die 43, and the gate 46 is provided at an exit of sprue 48 on the cavity 45 side.

Figure 9:
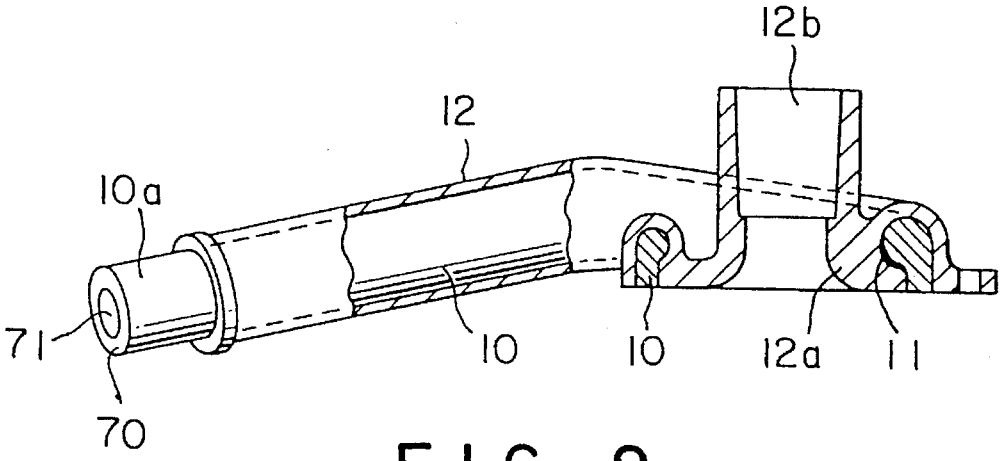
FIG. 9 is a partial, sectional view to show a core made of a synthetic resin and a cast product to represent a second embodiment of the present invention.

The synthetic resin core 10 as described below is set in the cavity 45 formed between the stationary die 41 and the movable die 43, and the aluminum cast product 12 is formed with this synthetic resin core 10 in place (FIG. 9).

The synthetic resin core 10 is next described referring to FIG. 9, FIG. 10, and FIGS. 11A and 11B. In FIG. 9, the synthetic resin core 10 consists of a core body 70 in which a space 71 is formed. The core body 70 is made of a synthetic resin, for example of impact-resistant and heat-resistant polycarbonate, and the synthetic resin core 10 has the projecting portion 10*a* which slightly projects from the casting product 12 after cast.

A portion of the synthetic resin core body 70, corresponding to (or in contact with) the thick portion 12*a* of the cast product 12 is coated with silicone rubber 11 having strong heat resistance. The thick portion 12*a* of cast product 12 is a portion where the escape of heat is slow. Because of it, the polycarbonate core body 70 could be melted near the thick portion 12*a*. Therefore, the coating of the silicone rubber 11 is provided so as to prevent melting of polycarbonate core body 70.

Figure 10A:
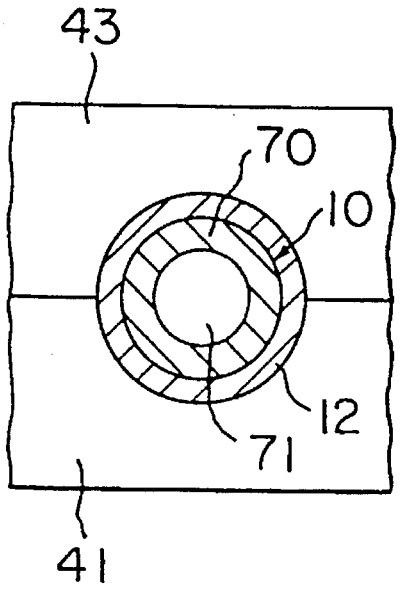
FIG. 10A is a sectional view to show the placement of a synthetic resin core and a cast product in a stationary die and a movable die.
Figure 11A:
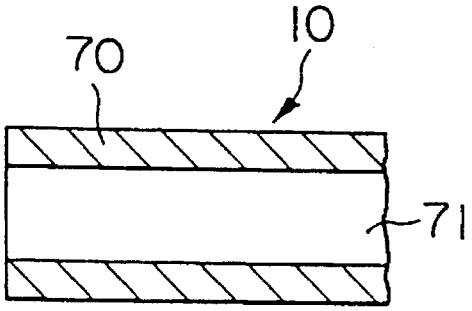
FIG. 11A is a partial, sectional view of the synthetic resin core.
Figure 11B:
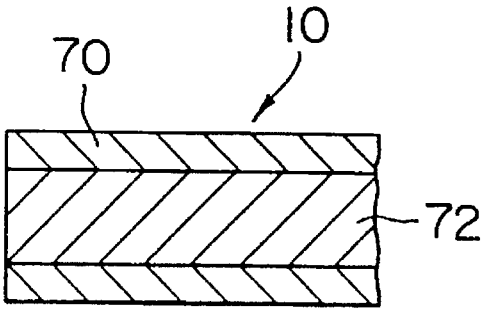
FIG. 11B is a partial, sectional view of the synthetic resin core.

The synthetic resin core 10 is further described below referring to FIG. 10A and FIG. 11A. As shown in FIG. 10A and FIG. 11A, the synthetic resin core 10 consists of the polycarbonate core body 70 in which the space 71 is formed, and the core body 70 has a predetermined thickness so as to provide sufficient strength to stand injection of molten aluminum as detailed here in after.

As shown in FIG. 10A and FIG. 11A, an amount of the expensive polycarbonate material can be reduced by making the synthetic resin core 10 of the polycarbonate core body 70 with the space 71 formed therein.

As shown in FIG. 3, the core drawing apparatus has the locking device 20 for locking the cast product 12 after casting, and the burner 27 for heating the cast product 12 locked by the locking device 20. The engagement pin 21 to be engaged with the hollow portion 12*b* of cast product 12 (FIG. 9) is fixed in the locking device 20.

Also, as shown in FIG. 3, the clamp device 30 for clamping and pulling the projecting portion 10*a* of the core 10 projecting from the cast product 12 is provided beside the locking device 20. This clamp device 30 has a pair of holding pawls 22, 22 arranged so as to be rockable through on the rocking shafts 23, 23 of the frame 28, and this pair of holding pawls 22, 22 hold the projecting portion 10*a* of core. Namely, the pair of the holding pawls 22, 22 are connected to each other through the connecting shaft 25, and are actuated to be closed when a pneumatic cylinder not shown pulls the connecting shaft 25 in the direction of arrow L in FIG. 3.

The frame 28 is arranged to be moved in the horizontal directions in FIG. 3 via the drive shaft 31 driven by a hydraulic cylinder not shown, and the horizontal movement of frame 28 is guided by the pair of guides 32, 32.

The operation of the present embodiment in the above arrangement is next described. First, in FIG. 4, the synthetic resin core 10 is set at a predetermined position in the stationary die 41, and thereafter the movable platen 42 and movable die 43 are moved toward the stationary platen 40 and stationary die 41 to make the movable die 43 closely fit with the stationary die 41. In this case, the cavity 45 is formed between the stationary die 41 and the movable die 43 whereby the core 10 is set in the cavity 45.

Figure 10B:
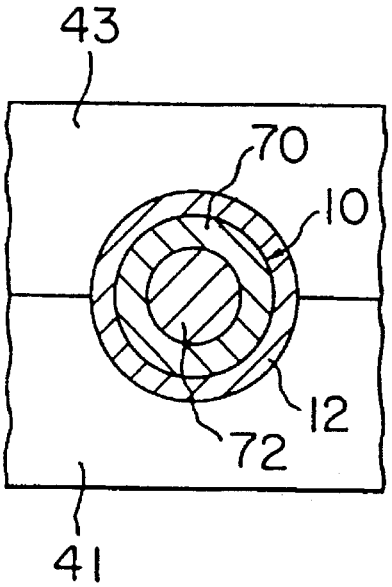
FIG. 10B is a sectional view to show the placement of a synthetic resin core and a cast product in a stationary die and a movable die.

Next, molten aluminum 55 at about 680° C. is put into the cylinder 50 through the input port 53 thereof and then the molten aluminum 55 is pushed toward the sprue 48 by the piston 51. The molten aluminum 55 entering the sprue 48 is injected through the gate 46 into the cavity 45 to fill a space formed by the stationary die 41, movable die 43, and core 10 (FIG. 10A and FIG. 10B). The molten aluminum 55 flowing from the gate 46 into the cavity 45 is sprayed, and the temperature thereof becomes about 600° C.

Next, the molten aluminum 55 which fills the cavity 45 is rapidly cooled by the stationary die 41 and movable die 43 to form the aluminum cast product 12.

During this period, heat transfer occurs also from the molten aluminum 55 to the synthetic resin core 10 consisting of the polycarbonate core body 70. However, because the thermal conductivity of the synthetic resin core 10 is normally far smaller than that of the steel stationary die 41 and movable die 43 (for example, the thermal conductivity of polycarbonate is $4.6\times10^{-4}$ cal/s•cm° C. while the thermal conductivity of iron is 0.18 cal/s•cm° C.), the amount of heat transfer from the molten aluminum 55 to the synthetic resin core 10 becomes extremely small. Thus, the synthetic resin core 10 is not melted during casting, and the cast product 12 can be made with excellent in accuracy of shape.

The synthetic resin core 10 will not be melted even with the slow escape of heat from the thick portion 12*a*, because the surface of the synthetic resin core 10 near the thick portion 12*a* of cast product 12 is coated with a very-high-temperature-resistant silicone rubber 11.

Next, the movable die 43 is separated from the stationary die 41, and the aluminum cast product 12 and synthetic resin core 10 are taken together out of the cavity 45 formed between the stationary die 41 and the movable die 43 (FIG. 9).

Next, the cast product 12 and synthetic resin core 10 are set on the locking device 20 shown in FIG. 3. In this case, the hollow portion 12*b* of cast product 12 is engaged with the engagement pin 21 of locking device 20 and secured thereto by the engagement pin 21.

Then the cast product 12 is completely heated by the burner 27 to heat the synthetic resin core 10 consisting of the polycarbonate core body 60 up to about 280° to 350° C. Since the softening point of polycarbonate is 160° C. and the melting point thereof is 380° to 400° C., the whole of core body 70 turns into a semi-molten state when the core body 60 is heated up to about 280° to 350° C. The projecting portion 10*a* of the synthetic resin core 10 is not heated as much so as to remain in a hard state.

Then the frame 28 of clamp device 30 is moved all the way to the cast product 12 and thereafter the pair of holding pawls 22, 22 hold the projecting portion 10*a* of the synthetic resin core 10. In this state the entire frame 28 is moved away from the cast product 12 by the drive shaft 31. In this case, the synthetic resin core 10 consisting of the polycarbonate core body 70 inside the cast product 12, being semi-molten, is integrally drawn rightward in FIG. 3 from the cast product 12.

After that, the cast product 12 is taken out of the locking device 20. Since the synthetic resin core 10 consisting of the polycarbonate core body 70 is integrally drawn out in the semi-molten state from the cast product 12, no scraps of core remain inside the cast product 12. Accordingly, the cast product 12 can be shipped as a final product as is. On the other hand, the synthetic resin core 10 drawn from the cast product is collected for reuse to form another core.

The aluminum die cast product 12 thus obtained is the cast product 12 having the inner space 18 (FIG. 20) corresponding to the core 10. As well as the die cast product 12 having the inner space 18, another die cast product 12 having an undercut portion can also be obtained using the core 10.

As described above, according to the present embodiment, the aluminum cast product 12 can be formed easily and accurately by using the synthetic resin core 10 consisting of the polycarbonate core body 70. The core 10 can be removed from the cast product 12 without any residual scraps of core in the cast product 12 simply by heating the casting product 12 after cast and drawing out the synthetic resin core 10 in the semi-molten state. Also, the core 10 can be produced at low cost, because the synthetic resin core 10 consists of the polycarbonate core body 70 having the space 71.

Modifications of the present invention will be described in the following.

The above embodiment showed an example in which the silicone rubber was applied to the surface of polycarbonate core body 70 located near the thick portion 12*a* of cast product 12, but the silicone rubber may be replaced by a thermosetting resin selected for example from melamine resins, phenol resins, urea resins, epoxy resins, silicon resins, polyurethane resins, and the like.

The above embodiment showed an example in which the synthetic resin core 10 consisted of the polycarbonate core body 70 having the space 71, but, without a need to be limited to it, the space 71 in the polycarbonate core body 70 may be filled with a filling of synthetic resin center body 72 made of a cheaper material than polycarbonate, for example of polyvinyl chloride or urethane rubber and the like, in order to increase the strength of the synthetic resin core 10.

This center body 72 may be made of grains of a synthetic resin or of an integral body of a synthetic resin.

As described above, according to the present invention, the cast product can be formed with high accuracy using the synthetic resin core consisting of the heat-resistant synthetic resin core body having the space and the core can be readily removed from the cast product without leaving scraps of core in the casting product after cast. Therefore, a cast product can be made with excellent accuracy of shape. Material costs can be reduced because the core body of synthetic resin has the space inside.

Further, a die cast product having an undercut portion or a hollow portion can be obtained in a reliable manner.

THIRD EMBODIMENT

The third embodiment of the present invention will be described with reference to the drawings.

FIG. 12 to FIG. 15 are drawings to show the third embodiment of the present invention. The same portions as those in the first embodiment are described with the same reference numerals. As shown in FIG. 4, the aluminum die casting apparatus is provided with the steel, stationary die 41 fixed to the stationary platen 40 and the steel, movable die 43 fixed to the movable platen 42, and is so arranged that when the stationary die 41 and movable die 43 are brought into close fit, the cavity 45 is formed between the two dies, similarly as in the first embodiment.

The cylinder 50 is provided on the opposite side of the stationary die 41 in the stationary platen 40, and the piston 51 is slidably arranged in the cylinder 50. The cylinder 50 is provided with the input port 53 through which molten aluminum is put into the cylinder.

The inside of cylinder 50 communicates through the sprue 48 with the cavity 45 formed between the stationary die 41 and the movable die 43, and the inlet gate 46 is provided at an exit of sprue 48 side where the cavity 45 is located.

Figure 12:
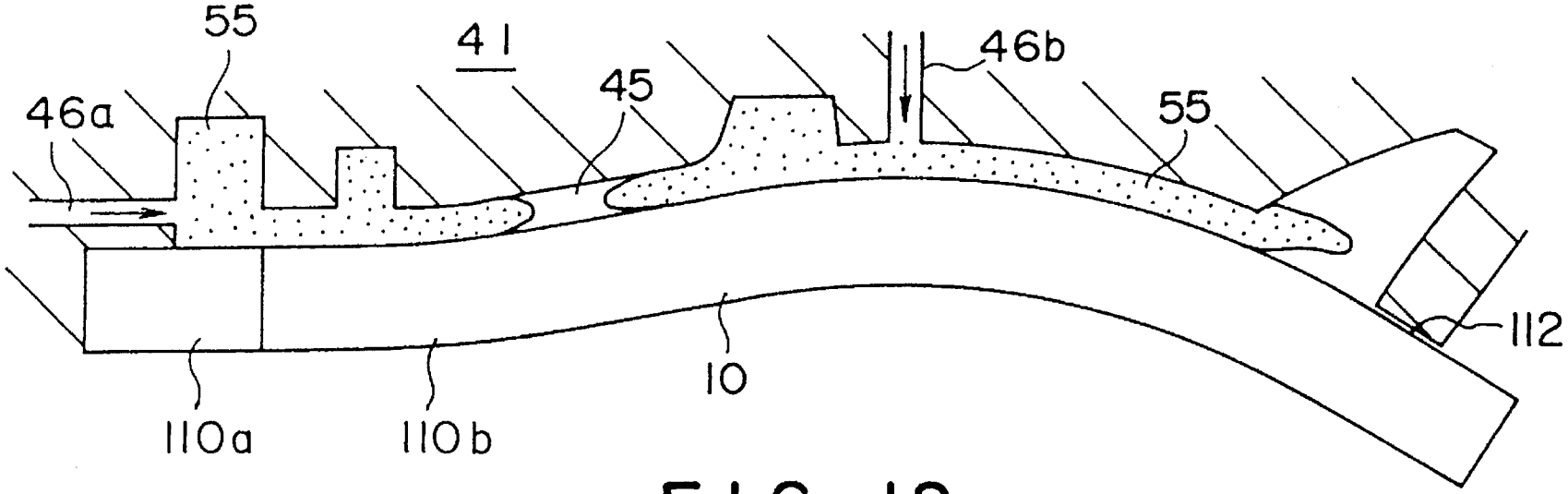
FIG. 12 is a partial, sectional view of a die casting apparatus and a core made of a synthetic resin to represent a third embodiment of the present invention.
Figure 13:
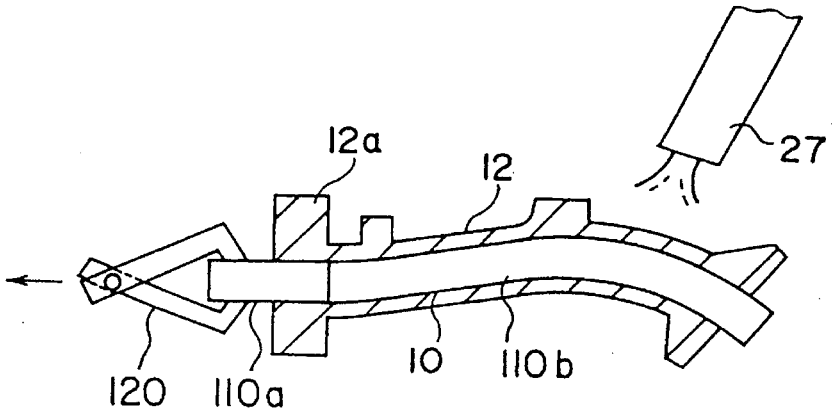
FIG. 13 is a sectional view to show a die cast product and a core made of a synthetic resin.

As shown in FIG. 12 and FIG. 13, the synthetic resin core 10 is set in the cavity 45 formed between the stationary die 41 and the movable die 43, and the synthetic resin core 10 is arranged to form the aluminum die cast product 12 (FIG. 13). The die cast product 12 is of an elongated shape and a plurality of injection gates 46*a*, 46*b* communicating with the inlet gate 46 are provided in the stationary die 41 along the longitudinal direction of cavity 45.

As shown in FIG. 12 and FIG. 13, the synthetic resin core 10 is composed of a synthetic resin portion 110*b* made of a synthetic resin, for example of heat-resistant polycarbonate, and a metal portion 110*a* of steel connected to the synthetic resin portion 110*b*. The metal portion 110*a* is located at the end portion in the cavity 45 and at a position corresponding to a flange portion (thick portion on the end side) 12*a* of cast product 12, projecting outward from inside the cavity 45. On the other hand, the synthetic resin portion 110*b* extends from the metal portion 110*a* through the inside of cavity 45.

Next described is a casting method using the synthetic resin core. First, in FIG. 4, the synthetic resin core 10 is set at a predetermined position in the stationary die 41, and thereafter the movable platen 42 and movable die 43 are moved toward the stationary platen 40 and stationary die 41 to make the movable die 43 closely fit with the stationary die 41. In this case, the cavity 45 is formed between the stationary die 41 and the movable die 43 whereby the synthetic resin core 10 is set in the cavity 45.

Next, as shown in FIG. 4, molten aluminum 55 at about 680° C. is put into the cylinder 50 through the input port 53 thereof and then the molten aluminum 55 thus put thereinto is pushed toward the sprue 48 by the piston 51. The molten aluminum 55 entering the sprue 48 is injected from the inlet gate 46 through the injection gates 46*a*, 46*b* into the cavity 45 to fill the cavity 45 (FIG. 12). The molten aluminum 55 flowing from the injection gates 46*a*, 46*b* into the cavity 45 is sprayed, and the temperature thereof becomes about 600° C.

The injection of molten aluminum is described in more detail referring to FIG. 12. As shown in FIG. 12, the stationary die 41 has the injection gates 46*a*, 46*b* provided at the left end portion and at the center portion of cavity 45 and the molten aluminum 55 is first injected through the injection gates 46*a*, 46*b* into the cavity 45 (first injection step). In this case, the injection pressure of molten aluminum 55 is about 300 to 400 kg/cm2 in an aluminum die casting apparatus of a relatively low pressure, for example of about 500 t. The molten aluminum 55 injected through the injection gate 46*a* advances rightward inside the cavity 45, while the molten aluminum 55 injected through the injection gate 46*b* advances both rightward and leftward.

When the molten aluminum 55 almost fills the remaining voids inside the cavity 45 as described, the injection pressure of the molten aluminum 55 is increased up to about 2000 kg/cm2 (second injection step). Various kinds of gases including air mixed in the molten aluminum 55 remain in the cavity 45, but by increasing the injection pressure of the molten aluminum 55, the remaining gases in the cavity 45 can be discharged from inside the cavity 45 for example through a clearance 112 between the stationary die 41 and movable die 43, and the synthetic resin core 10 to the outside.

As described, the molten aluminum 55 is injected in a relatively low pressure before almost all of the voids remaining in the cavity 45, whereby the mechanical stress on the synthetic resin core 10 is kept at a low level. In addition, the injection pressure of the molten aluminum 55 is increased after almost all of the voids remaining in the cavity 45 are filled with the molten aluminum 55, whereby the remaining gases can be discharged from inside the cavity 45 to the outside. By this, the core 10 is protected from deformation during casting and is protected from the formation of porosities.

Since the injection gates 46*a*, 46*b* are provided at the left end portion and at the center portion of cavity 45 in the stationary die 41, the molten aluminum 55 can uniformly fill the cavity 45 and the molten aluminum 55 can be fully spread throughout the cavity 45 even under a low injection pressure.

The molten aluminum 55 which fills the cavity 45 is rapidly cooled by the stationary die 41 and movable die 43 to form the aluminum cast product 12.

During this period, heat transfer occurs also from the molten aluminum 55 to the synthetic resin core 10, particularly to the synthetic resin portion 110*b* of polycarbonate. However, because the thermal conductivity of the synthetic resin portion 110*b* is normally far smaller than that of the steel stationary die 41 and movable die 43 (for example, the thermal conductivity of polycarbonate is $4.6\times10^{-4}$ cal/s•cm° C. while the thermal conductivity of iron is 0.18 cal/s•cm° C.), the amount of heat transfer from the molten aluminum 55 to the synthetic resin portion 10*b* becomes extremely small. Thus, the synthetic resin portion 110*b* is not melted during casting, and a cast product 12 is formed with excellent accuracy of shape.

The thick portion 12*a* on the end side of the cast product 12 is a portion where the escape of heat is slower. Therefore, if the synthetic resin portion 110*b* were arranged at the portion corresponding to the end thick portion 12*a*, an imbalance would occur between an amount of heat conduction from the molten aluminum 55 to the stationary die 41 and movable die 43 and an amount of heat conduction to the core 10, which would cause shrinkage in the end thick portion 12*a*. However, when the metal portion 110*a* is placed at the position corresponding to the thick end portion 12*a*, a difference is made smaller between the amount of heat conduction from the molten aluminum 55 to the stationary die 41 and movable die 43 and the amount of heat conduction from the molten aluminum 55 to the core 10, whereby shrinkage can be prevented from appearing in the thick end portion 12*a*.

Next, the movable die 43 is separated from the stationary die 41, and the aluminum cast product 12 and synthetic resin core 10 are taken together out of the cavity 45 formed between the stationary die 41 and the movable die 43.

Then the cast product 12 is thoroughly heated by the burner 27 to heat the synthetic resin core 10, particularly the synthetic resin portion 110*b* of polycarbonate, up to about 280° to 350° C. Since the softening point of polycarbonate is 160° C. and the melting point thereof is 380° to 400° C., the synthetic resin portion 110*b* turns into a semi-molten state when the synthetic resin portion 110*b* is heated up to about 280° to 350° C. The metal portion 110*a* is not heated as much.

Next, the metal portion 110*a* of the synthetic resin core 10 is held by a clamp device 120. In this state the clamp device 120 is moved away from the cast product 12, whereby the synthetic resin portion 110*b* of the synthetic resin core 10 set in the cast product 12 is drawn out in the semi-molten state leftward as shown in FIG. 13 from the cast product 12.

Figure 14:
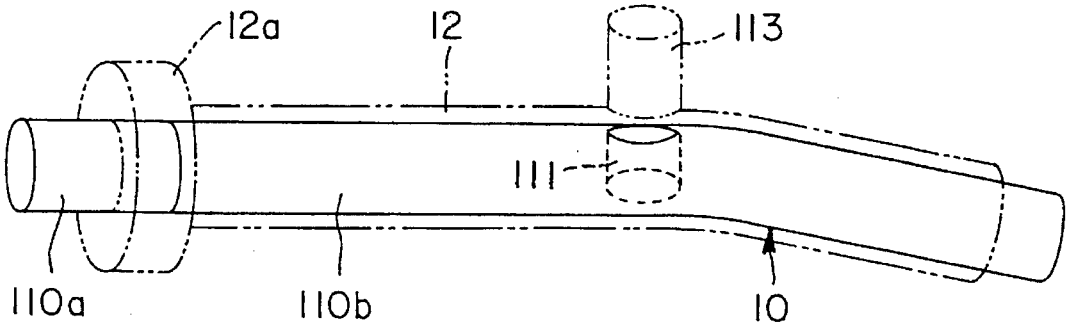
FIG. 14 is a perspective view to show a die cast product and a core made of a synthetic resin to show another embodiment of the present invention.
Figure 15:
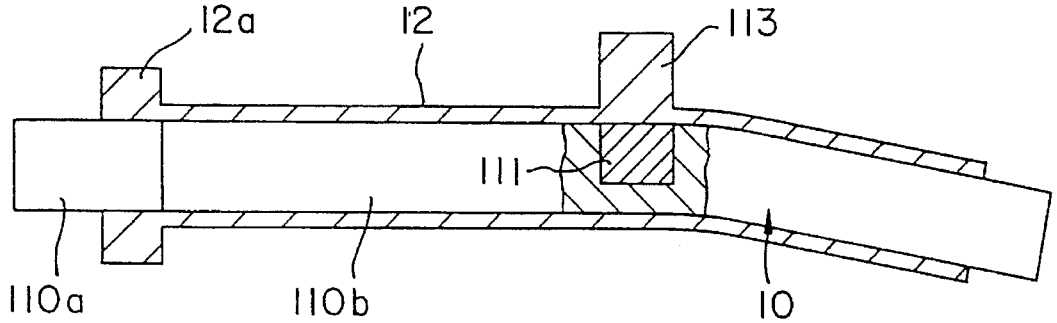
FIG. 15 is a sectional view of the die cast product and the synthetic resin core shown in FIG. 14.

Another embodiment of the present invention is next described referring to FIG. 14 and FIG. 15. In the embodiment shown in FIG. 14 and FIG. 15, the aluminum cast product 12 has an inside thick portion 113 nearly at the central portion in the longitudinal direction in addition to the end thick portion 12*a* and a metal portion 111 which is embedded at a position corresponding to the inside thick portion 113 in the synthetic resin portion 110*b* of the core 10. Other parts are substantially the same as those in the embodiment shown in FIG. 12 to FIG. 14.

As shown in FIG. 14 and FIG. 15, in the synthetic resin portion 110*b* of the core, the embedded metal portion 111 of aluminum is embedded but exposed at the position corresponding to the inside thick portion 113 in the surface of the synthetic resin portion 110*b*. Because of this arrangement, where the core shown in FIG. 14 and FIG. 15 is set in the cavity 45 (FIG. 12) between the stationary die 41 and the movable die 43 and thereafter the molten aluminum 55 is introduced into the cavity 45, there is no shrinkage caused in the inside thick portion 113 of the cast product 12.

Namely, though the inside thick portion 110 is a portion where an escape of heat becomes slower, the arrangement where the embedded metal portion 111 of aluminum is disposed at the position corresponding to the inside thick portion 113 in the synthetic resin portion 110*b* can reduce a difference between an amount of heat conduction from the molten aluminum 55 to the stationary die 41 and movable die 43 and an amount of heat conduction from the molten aluminum 55 to the embedded metal portion 111, whereby no shrinkage occurs in the inside thick portion 113.

The aluminum cast product 12 is then taken together with the synthetic resin core 10 out of the cavity 45 between the stationary die 41 and the movable die. After that, the cast product 12 is thoroughly heated to convert the synthetic resin core 10, particularly the synthetic resin portion 110*b* of polycarbonate, into the semi-molten state and to draw the core 10 out from the cast product 12.

The above embodiments showed examples using the die casting core 10 for the aluminum die casting method, but the material is not limited to aluminum. For example, the material may be lead, zinc, magnesium, manganese, or an alloy thereof.

According to the present invention, there is no imbalance between the amount of heat conduction from the molten metal to the dies and the amount of heat conduction from the molten metal to the metal portion of the core at the positions corresponding to the thick end portions, thereby preventing shrinkage at the thick end portions of the cast product. Further, there is no imbalance between the amount of heat conduction from the molten metal to the dies and the amount of heat conduction from the molten metal to the embedded metal portion of the core at the position corresponding to the inside thick portion, thereby preventing shrinkage at the inside thick portion of the metal product.

FOURTH EMBODIMENT

The fourth embodiment of the present invention will now be described with reference to the drawings.

FIG. 16 to FIG. 23 are drawings to show an embodiment of the present invention. The same portions as those in the first embodiment are described with the same reference numerals. As shown in FIG. 4, the aluminum die casting apparatus is provided with the steel, stationary die 41 fixed to the stationary platen 40 and the steel, movable die 43 fixed to the movable platen 42, and is so arranged that when the stationary die 41 and movable die 43 are brought into close fit, the cavity 45 is formed between the two dies, similarly as in the first embodiment.

The cylinder 50 is provided on the opposite side of the stationary die 41 in the stationary platen 40, and the piston 51 is slidably arranged in the cylinder 50. The cylinder 50 is provided with the input port 53 through which molten aluminum is put into the cylinder.

The inside of cylinder 50 communicates through the sprue 48 with the cavity 45 formed between the stationary die 41 and the movable die 43, and the gate 46 is provided at an exit of the sprue 48 on the side where the cavity 45 is located.

Figure 16:
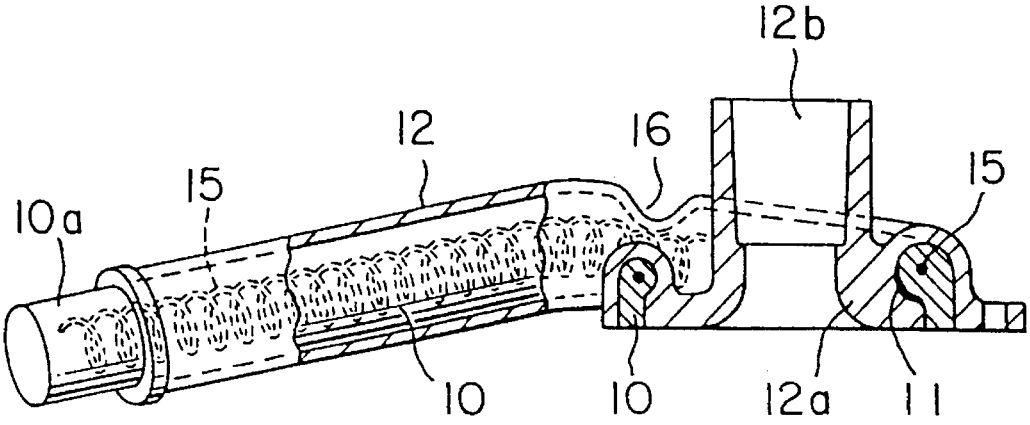
FIG. 16 is a partial, sectional view to show a core made of a synthetic resin and a cast product to represent a fourth embodiment of the present invention.
Figure 17:
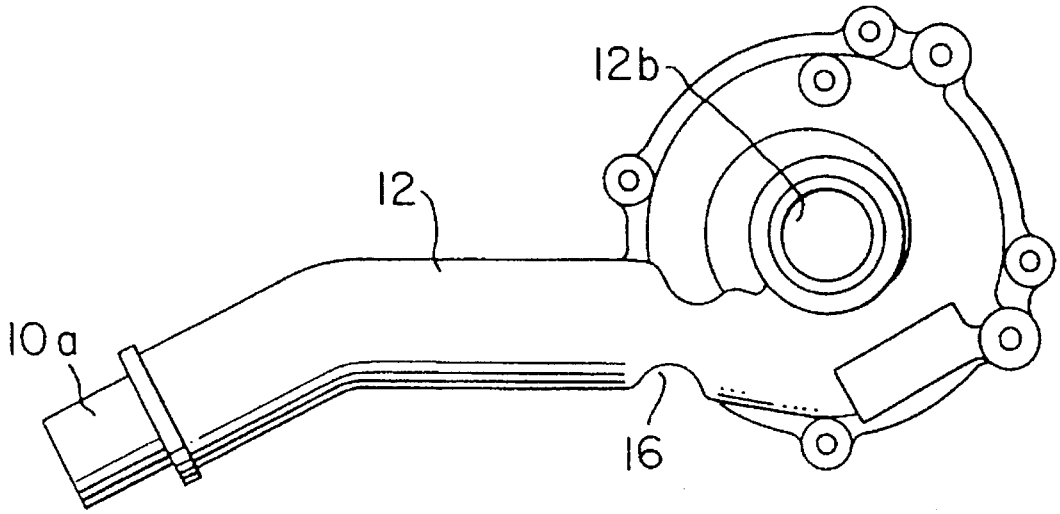
FIG. 17 is a plan view to show the synthetic resin core and the cast product shown in FIG. 16.

The synthetic resin core 10 is set in the cavity 45 formed between the stationary die 41 and the movable die 43, and the aluminum cast product 12 having the inner space 18 (FIG. 20) is formed with this synthetic resin core 10 in place (FIG. 16 and FIG. 17). Also, a decreased-diameter 16 projected into the inner space 18 is formed near the central portion of the cast product 12.

The synthetic resin core 10 is next described referring to FIG. 16 and FIG. 17. In FIG. 16 and FIG. 17, the synthetic resin core 10 is made of a synthetic resin, for example of heat-resistant polycarbonate, and the synthetic resin core 10 has the projecting portion 10*a* which slightly projects from the casting product 12 after cast.

A portion of the synthetic resin core 10 corresponding to (or in contact with) the thick portion 12*a* of the cast product 12 is coated with a silicone rubber 11 having strong heat resistance. The thick portion 12*a* of cast product 12 is a portion where the escape of heat is slow. Because of it, the polycarbonate core 10 could be melted near the thick portion 12*a*. To prevent such melting of the polycarbonate core 10, the coating of the silicone rubber 11 is provided. Furthermore, the synthetic resin core 10 has a center member inside as shown in FIG. 16, for example a compression spring 15 of steel. This compression spring 15 functions to reinforce the core 10 upon drawing of the core so as to prevent any separation of the core 10, as described later.

Figure 18:
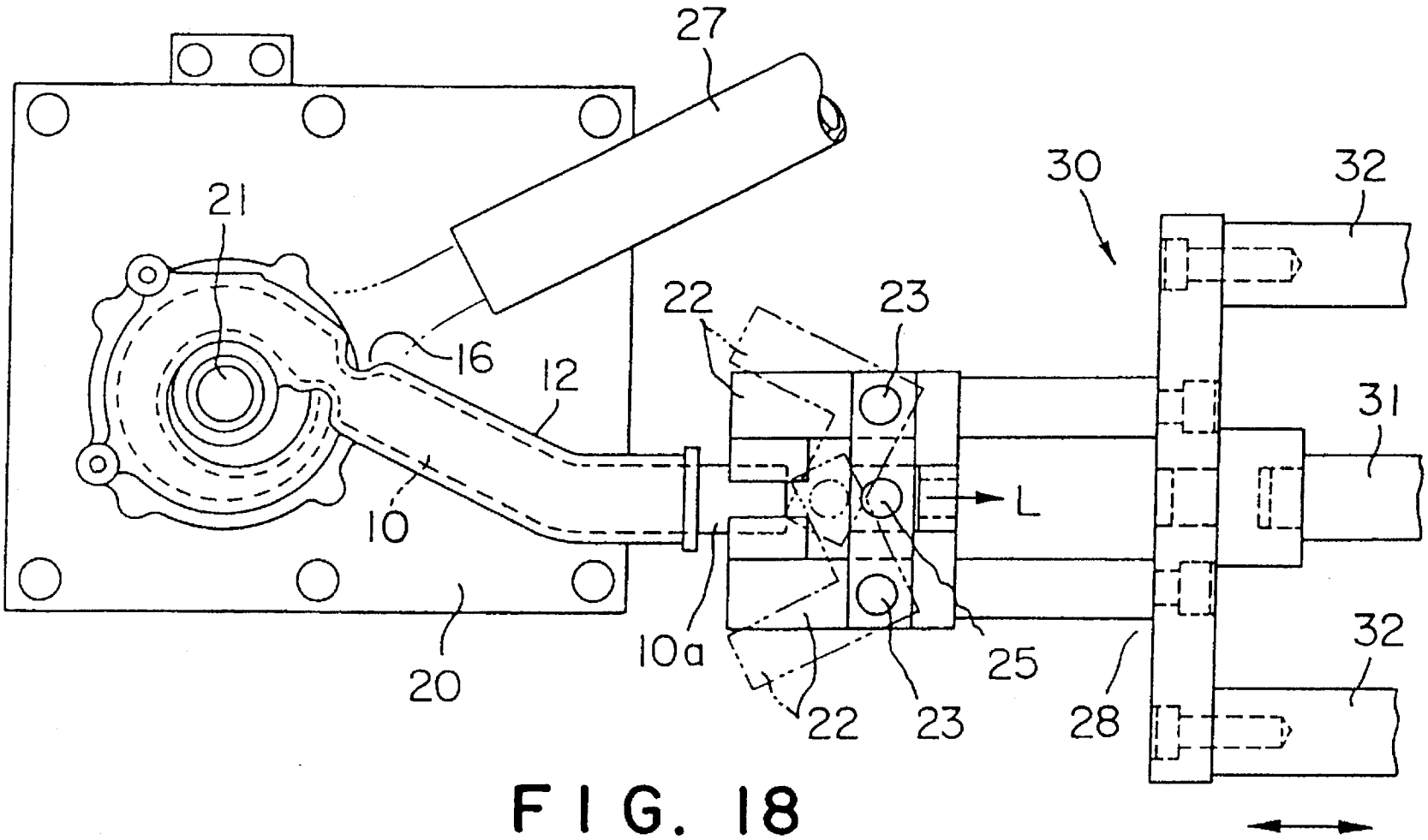
FIG. 18 is a plan view to show a core drawing apparatus for the synthetic resin core.

The core drawing apparatus is next described referring to FIG. 18. As shown in FIG. 18, the core drawing apparatus has the locking device 20 for locking the cast product 12 after casting, and the burner 27 for heating the cast product 12 locked by the locking device 20. The engagement pin 21 to be engaged with the hollow portion 12*b* of cast product 12 (FIG. 16 and FIG. 17) is fixed in the locking device 20.

Also, as shown in FIG. 18, the clamp device 30 for clamping and pulling the projecting portion 10*a* of core 10 projecting from the cast product 12 is provided beside the locking device 20. This clamp device 30 has a pair of holding pawls 22, 22 arranged so as to be rockable on rocking shafts 23, 23 on the frame 28, and this pair of the holding pawls 22, 22 hold the projecting portion 10*a* of core. Namely, the pair of holding pawls 22, 22 are connected to each other through the connecting shaft 25, and are actuated toward closure when the pneumatic cylinder not shown pulls the connecting shaft 25 in the direction of arrow L in FIG. 18.

The frame 28 is arranged to be moved in the horizontal directions an shown in FIG. 18 through a drive shaft 31 driven by a hydraulic cylinder not shown, and the horizontal movement of frame 28 is guided by the pair of guides 32, 32.

Next described is the casting method using the synthetic resin core. First, in FIG. 4, the synthetic resin core 10 is set at a predetermined position in the stationary die 41, and thereafter the movable platen 42 and movable die 43 are moved toward the stationary platen 40 and stationary die 41 to make the movable die 43 closely fit with the stationary die 41. In this case, the cavity 45 is formed between the stationary die 41 and the movable die 43 whereby the core 10 is set in the cavity 45.

Figure 19:
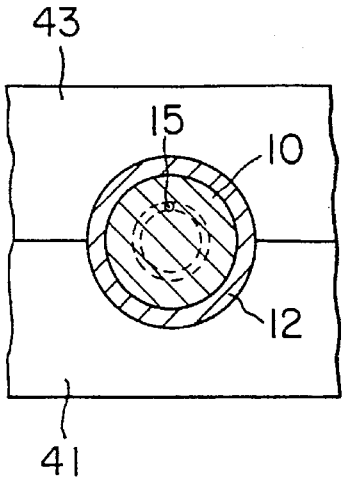
FIG. 19 is a sectional view to show the placement of a synthetic resin core and a cast product in a stationary die and a movable die.

Next, molten aluminum 55 at about 680° C. is put into the cylinder 50 through the input port 53 thereof and then the molten aluminum 55 is pushed toward the sprue 48 by the piston 51. The molten aluminum 55 entering the sprue 48 is injected through the gate 46 into the cavity 45 to fill a casting space formed by the stationary die 41, movable die 43, and core 10 (FIG. 19). The molten aluminum 55 flowing from the gate 46 into the cavity 45 is sprayed, and the temperature thereof becomes about 600° C.

Next, the molten aluminum 55 which fills the cavity 45 is rapidly cooled by the stationary die 41 and movable die 43 to form the aluminum cast product 12.

During this period, heat transfer occurs also from the molten aluminum 55 to the synthetic resin core 10 of polycarbonate. However, because the thermal conductivity of the synthetic resin core 10 is normally far smaller than that of the steel stationary die 41 and movable die 43 (for example, the thermal conductivity of polycarbonate is $4.6\times 10^{-4}$ cal/s•cm° C. while the thermal conductivity of iron is 0.18 cal/s•cm° C.), the amount of heat transfer from the molten aluminum 55 to the synthetic resin core 10 becomes extremely small. Thus, the synthetic resin core 10 is not melted during casting, and a cast product 12 is formed with excellent accuracy of shape.

The synthetic resin core 10 will not be melted even with slow escape of heat from the thick portion 12*a*, because the surface of the synthetic resin core 10 near the thick portion 12*a* of the cast product 12 is coated with very-high-temperature-resistant silicone rubber 11.

Next, the movable die 43 is separated from the stationary die 41, and the aluminum cast product 12 and synthetic resin core 10 are taken together out of the cavity 45 formed between the stationary die 41 and the movable die 43 (FIG. 16 and FIG. 17).

Next, the cast product 12 and synthetic resin core 10 are set on the locking device 20 shown in FIG. 18. In this case, the hollow portion 12*a* of cast product 12 is engaged with the engagement pin 21 of the locking device 20 and is secured thereto by the engagement pin 21.

Then the cast product 12 is thoroughly heated by the burner 27 to heat the synthetic resin core 10 of polycarbonate up to about 280° to 350° C. Since the softening point of polycarbonate is 160° C. and the melting point thereof is 380° to 400° C., the whole of core 10 turns into a semi-molten state when the synthetic resin core 10 is heated up to about 280° to 350° C. The projecting portion 10*a* is not heated as much so as to remain in a hard state.

Then the frame 28 of clamp device 30 is moved all the way to the cast product 12 and thereafter the pair of holding pawls 22, 22 hold the projecting portion 10*a* of the synthetic resin core 10. In this state the entire frame 28 is moved away from the cast product 12 by the drive shaft 31. By this, the synthetic resin core 10 inside the cast product 12, being semi-molten, is integrally drawn rightward in FIG. 3 from the cast product 12.

In this case, because the synthetic resin core 10 has the compression spring 15 inside, the core 10 is reinforced by the compression spring 15. By this arrangement the core 10 can be drawn together out of the cast product 12 without any separation.

As described, the cast product 12 having the inner space 18 is obtained and thereafter the cast product 12 is taken out of the locking device 20. As described previously, the decreased-diameter portion 16 projecting into the inner space 18 is formed near a central portion of the cast product 12, so that a residue of core 10 could remain deposited on the inner surface of the inner space 18 near the decreased-diameter portion 16. Namely, when the synthetic resin core 10 is drawn in the semi-molten state out of the cast product 12, a part of core 10 is caught by the decreased-diameter portion 16 projecting into the inner space 18, thereby remaining as a residue. In this case, the residual core remaining in the inner space 18 needs to be removed. Methods for removing the residual core are next described.

Figure 20:
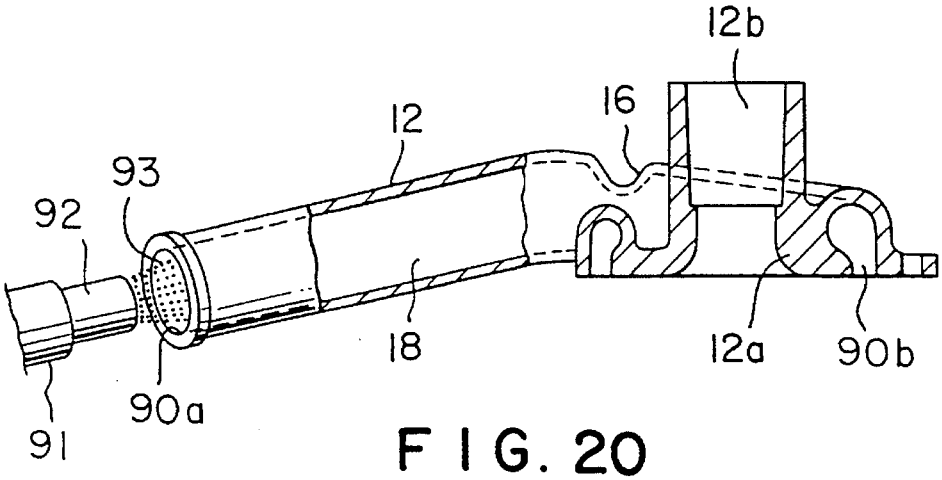
FIG. 20 is a drawing to show a method for removing a residual part of core remaining in an internal space of a cast product by shot blast.

First described referring to FIG. 20 is a method for peeling off the residual core by shot blast.

As shown in FIG. 20, a shot blast apparatus 91 having a nozzle 92 is brought near an opening 90*a* of the cast product 12 and a lot of shots 93 are ejected (or blasted) into the inner space 18 of the cast product 12 through the nozzle 92. Then the ejected shots 93 peel off the residual core of polycarbonate remaining in the inner space 18, particularly on the inner surface near the decreased-diameter portion 16. The residual core peeled off from the inner surface of inner space 18 is then discharged together with the shots 93 through the other opening 90*b*.

During the shot blast operation with the above shot blast apparatus 91, the cast product 12 may be heated to about 200° C., whereby the peeling-off removal of the residual core becomes easier. The shots 93 may be aluminum powder, glass powder, silica powder, graphite powder, salt powder, or any other anti-rust metal powder.

Next described is a method for peeling off and removing the residual core by high-temperature and high-pressure steam.

Figure 21:
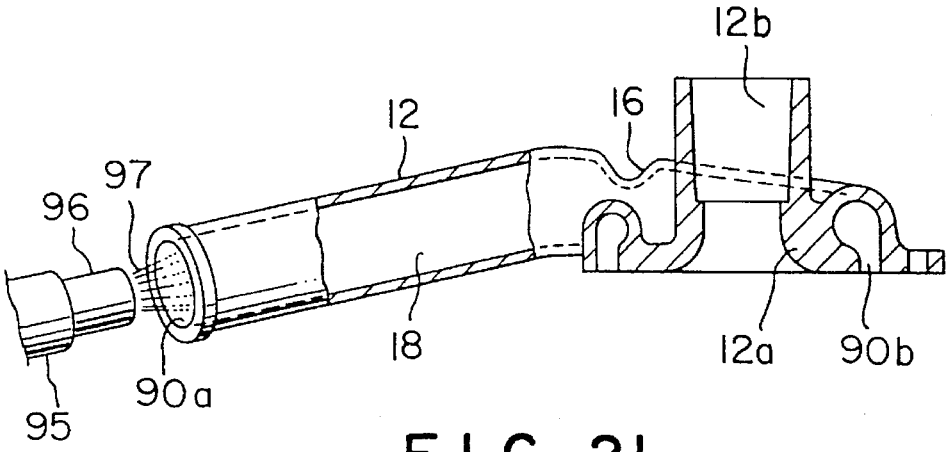
FIG. 21 is a drawing to show a method for removing a residual part of core remaining in an internal space in a cast product by high-temperature and high-pressure steam.

As shown in FIG. 21, a steam spraying apparatus 95 is set close to one opening 90*a* of the cast product 12 and then high-temperature and high-pressure steam 97 (for example steam at 300° C. to 500° C.) is sprayed through a nozzle 96. The thus sprayed steam 97 peels off and removes the polycarbonate residual core remaining on the inner surface of inner space 18 near the decreased-diameter portion 16. The residual core peeled off from the inner surface of inner space 18 is then discharged together with steam 97 from the other opening 90*b*.

Next described referring to FIG. 22 is a method for peeling off and removing the residual core with a solvent.

As shown in FIG. 22, a solvent 101 is poured into a receptacle 98 and the cast product 12 is immersed in the solvent 101. In this case, the polycarbonate residual core remaining on the inner surface of inner space 18 in the cast product 12 can be washed out with the solvent 101 which dissolves and removes the polycarbonate residual core.

The solvent for dissolving and removing the polycarbonate residual core is one selected from the following hydrocarbon solvents.

Methylene chloride (dichloromethane or methylene chloride), NMP (N-methyl-2-olefin), DMP (NN-dimethylformamide), MFK (methyl ethyl ketone), and ethyl acetate (ester).

Further, an ultrasonic generator 100 is set in the solvent 101, so that ultrasonic waves are generated in the solvent 101 by the ultrasonic generator 100, thereby quickly dissolving and removing the polycarbonate residual core remaining on the inner surface defining inner space 18.

As described above, according to the present embodiment, the aluminum cast product 12 can be formed easily and precisely using the synthetic resin core 10 of polycarbonate. After casting, the core 10 can be removed from the cast product 12 simply by heating the cast product 12 and drawing out the synthetic resin core 10 while in the semi-molten state. Also, the residual core remaining on the inner surface of inner space 18 in the cast product 12 can be easily and simply removed using the shot blast, high-temperature and high-pressure steam, or solvent.

Figure 23:
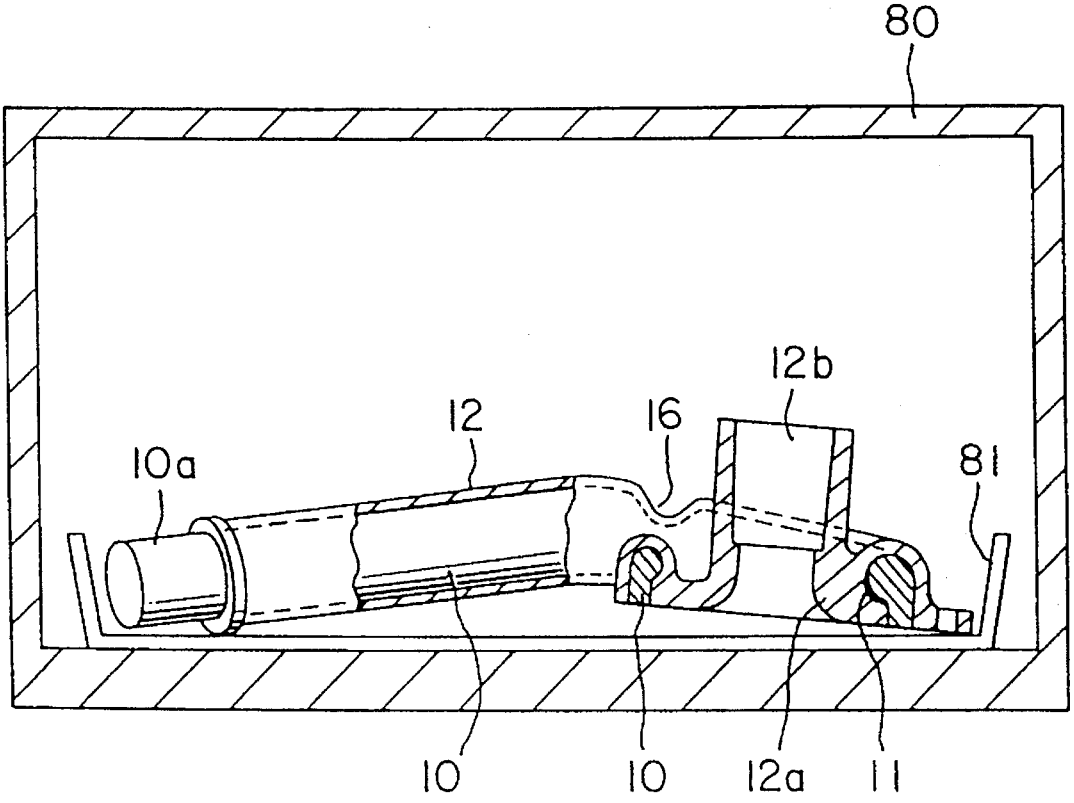
FIG. 23 is a drawing to show a state in which a cast product and a core made of a synthetic resin are set in a furnace.

Another embodiment of the present invention is next described referring to FIG. 23. The embodiment shown in FIG. 23 is substantially the same as the embodiment shown in FIG. 16 to FIG. 22 except that the synthetic resin core 10 is a polycarbonate core without a compression spring and that the aluminum cast product 12 and synthetic resin core 10 are taken out of the cavity between the stationary die 41 and the movable die 43 and the cast product 12 and synthetic resin core 10 thus taken out are heated in a furnace.

As shown in FIG. 23, the synthetic resin core 10 is a polycarbonate core without a compression spring, casting is carried out while setting the core 10 in the cavity (FIG. 4) between the stationary die 41 and movable die 43, and thereafter the aluminum cast product 12 and synthetic resin core 10 are taken out of the cavity between the stationary die 41 and the movable die 43. Then the aluminum cast product 12 and synthetic resin core 10 are set on a receptacle 81 in the furnace 80, and then they are heated in the furnace 80 up to a temperature corresponding to the the melting point of polycarbonate (380° to 400° C.) to 600° C.

Generally, shrinkage would occur inside the aluminum cast product 12 when heated up to about 600° C., but using nonporous aluminum cast product 12, it can fully withstand a temperature of about 600° C. without shrinkage.

With heating in the furnace 80, the synthetic resin core 10 is melted to flow out of the aluminum cast product 12, so that the polycarbonate ingredient in the synthetic resin core 10 is collected in the receptacle 81.

Another possible arrangement is such that after the aluminum cast product 12 and synthetic resin core 10 are taken out of the cavity between the stationary die 41 and the movable die 43, the aluminum cast product 12 and synthetic resin core 10 are immersed in the solvent 101 (FIG. 22) instead of being heated in the furnace, whereby the synthetic resin core 10 is dissolved out of the aluminum cast product 12.

In the above embodiment the aluminum die casting method was described as a die casting method, but the casting method of the present invention can be applied to any other die casting methods, such as the gravity die casting method, the low pressure die casting method, and the precision die casting method. Further, the cast product may be not only of aluminum, but also of lead, zinc, magnesium, manganese or an alloy thereof.

As described above, according to the present invention, the residual core remaining in the inner space of the cast product can be easily and simply removed. Therefore, a cast product can be obtained with a clean inner surface having no residual core. Also, the synthetic resin core can be removed as it is melted out of the cast product in the furnace. By this, a cast product can also be obtained with a clean inner surface. Further, the synthetic resin core can be dissolved in the solvent out of the cast product. This can also provide a cast product with a clean inner surface. The core can be integrally drawn out of the cast product without separation. Thus, an amount of the residual core remaining in the inner space of the cast product can be minimized.

Waht is claimed is:

1. A casting method using a synthetic resin core, comprising:

a step of placing the synthetic resin core in dies;

a step of filling the dies in which the synthetic resin core is placed, with a molten metal;

a step of cooling the molten metal in the dies to form a cast product with a projecting portion projecting from the dies, then;

a step of taking the cast product and the synthetic resin core out of the dies, then;

a step of heating the cast product and the synthetic resin core so that said synthetic resin core achieves a softened state; and a step of holding and pulling out the projecting portion using a clamp device so that the synthetic resin core in the softened state is drawn out of the cast product, thereby forming an inner space in the cast product.

2. The casting method using a synthetic resin core according to claim 1, wherein the synthetic resin core is a polycarbonate core and the cast product is heated to 250° to 300° C. to draw the synthetic resin core in a softened state out thereof.

3. The casting method using a synthetic resin core according to claim 1, further comprising a step of peeling off and removing any residual core remaining in the inner space of the cast product by shot blasting.

4. The casting method using a synthetic resin core according to claim 3, wherein the cast product is heated during said step of peeling off and removing the residual core by shot blasting.

5. The casting method using a synthetic resin core according to claim 1, further comprising a step of blowing off and removing a residual core remaining in the inner space in the cast product by high-temperature, high-pressure steam.

6. The casting method using a synthetic resin core according to claim 5, wherein the synthetic resin core is a polycarbonate core and the high-temperature, high-pressure at a temperature is steam of 300° C. to 500° C.

7. The casting method using a synthetic resin core according to claim 1, further comprising a step of immersing the cast product in a solvent and thereby dissolving out any residual core remaining in the inner space of the cast product.

8. The casting method using a synthetic resin core according to claim 7, wherein upon dissolving out to remove the residual core with the solvent, ultrasonic waves are generated in the solvent to aid in removing the residual core.

* * * * *